US008726701B2

(12) United States Patent
Habert

(10) Patent No.: US 8,726,701 B2
(45) Date of Patent: May 20, 2014

(54) METHOD OF MAKING A KNIT APPAREL WITH A TIE DYED APPEARANCE AND AN APPAREL MADE BY THE METHOD

(75) Inventor: Joseph Habert, Brooklyn, NY (US)

(73) Assignee: The Moret Group, New York, NY (US)

( * ) Notice: Subject to any disclaimer, the term of this patent is extended or adjusted under 35 U.S.C. 154(b) by 0 days.

(21) Appl. No.: 13/422,064

(22) Filed: Mar. 16, 2012

(65) Prior Publication Data

US 2012/0266635 A1 Oct. 25, 2012

Related U.S. Application Data

(60) Provisional application No. 61/453,754, filed on Mar. 17, 2011.

(51) Int. Cl.
*D04B 15/78* (2006.01)

(52) U.S. Cl.
USPC ..... 66/232

(58) Field of Classification Search
USPC ..... 700/141, 131–133; 66/232, 237
See application file for complete search history.

(56) References Cited

U.S. PATENT DOCUMENTS

| | | | | |
|---|---|---|---|---|
| 4,608,642 | A * | 8/1986 | Shima | 700/141 |
| 5,388,050 | A * | 2/1995 | Inoue et al. | 700/131 |
| 5,557,527 | A * | 9/1996 | Kotaki et al. | 700/131 |
| 6,611,730 | B1 * | 8/2003 | Stoll et al. | 700/131 |
| 6,880,367 | B2 * | 4/2005 | Suzuki | 66/232 |
| 6,895,787 | B2 * | 5/2005 | Maeiwa | 66/232 |
| 7,272,462 | B2 * | 9/2007 | Smedley et al. | 700/141 |
| 7,460,927 | B1 * | 12/2008 | Lai | 700/141 |
| 8,050,791 | B2 * | 11/2011 | Li | 700/133 |
| 2004/0065380 | A1 * | 4/2004 | Speich | 139/383 R |
| 2007/0156276 | A1 * | 7/2007 | Smedley et al. | 700/141 |

FOREIGN PATENT DOCUMENTS

JP 2001089907 A * 4/2001 ..... A41D 1/00

* cited by examiner

*Primary Examiner* — Danny Worrell
(74) *Attorney, Agent, or Firm* — Gottlieb, Rackman & Reisman, P.C.

(57) ABSTRACT

A knit apparel is made using a decorating pattern that is generated to give the apparel the appearance of tie dyed apparel. The decorating pattern includes a main element, a secondary element and intermediate zones have the same color but gradually lighter shades as the main element.

19 Claims, 5 Drawing Sheets

METHOD OF MAKING A KNIT APPAREL WITH A TIE DYED APPEARANCE AND AN APPAREL MADE BY THE METHOD

RELATED APPLICATIONS

This application claims priority to U.S. Provisional application Ser. No. 61/453,754 filed on Mar. 17, 2011 and incorporated herein its entirety.

BACKGROUND OF THE INVENTION

A. Field of Invention

This invention pertains to a method of making a knit apparel, and more particular to apparel such as socks that are knitted to give them a tie dyed appearance. The invention also covers the apparel resulting from the method.

B. Description of the Prior Art

Tie-dying is a well known technique for decorating various types of apparels. This technique consists of taking a fabric apparel, folding it into a pattern, binding the folded fabric and then applying to it one or more dyes. The apparel is then unbound, rinsed and the dye is set.

The apparel can be made of a woven, non-woven or knit material and it is originally either white or has some other uniform, neutral color. During the process different portions of the fabric are dipped into a dye, and the dye then spreads or bleeds through the fabric forming bands in somewhat random patterns characteristic of this technique.

A problem with this known technique is that over time the dyed fabric loses starts fading and the colors and patterns lose their vibrancy.

Another problem is that it is normally performed by hand and it is difficult to duplicate it on automated machinery Moreover, typically fabrics used for tie dyed apparels are usually made of very thin woven fabrics which are not suitable for certain kinds of apparels because they are not warm and do not stretch enough. For example, certain apparels, such as socks are made of knit rather than woven materials. However it is well known in the art that knit materials are not suitable for tie dying.

SUMMARY OF THE INVENTION

A method of making a knit apparel in accordance with this invention includes the steps of:

obtaining a decorating pattern including a main image element in a dominant color and having a demarcation line, a secondary image having a second color different from said dominant color and at least one intermediate zone disposed along said demarcation line and separating said main image element from said secondary image element, wherein said intermediate zone has a demarcation color that is a lighter shade of said dominant color;

generating a knitting pattern from said decorating pattern; and knitting said knit apparel using said knitting pattern.

DETAILED DESCRIPTION OF THE INVENTION

The present invention pertains to a method of making knit apparel, such as socks having an appearance that simulates tie dying. The method is performed as follows.

Figure 1:
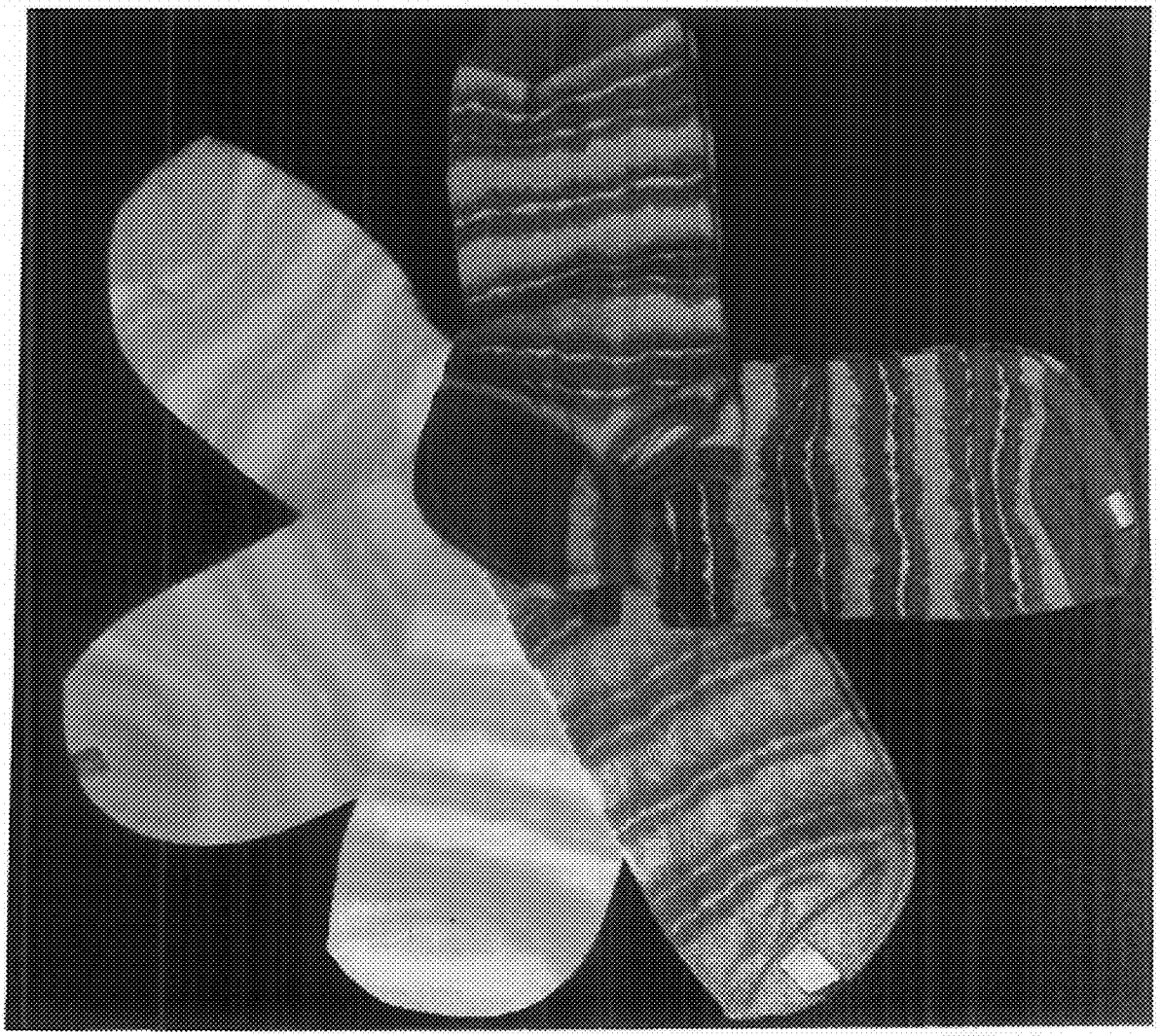
FIG. 1 shows a plurality of socks with a first tie dyed pattern in accordance with this invention.

First, a pattern for a sock is generated as an image. In one embodiment of the invention, the pattern consists of lines of uneven thickness. FIG. 1 shows several different colored socks with line patterns of this kind.

Figure 2:
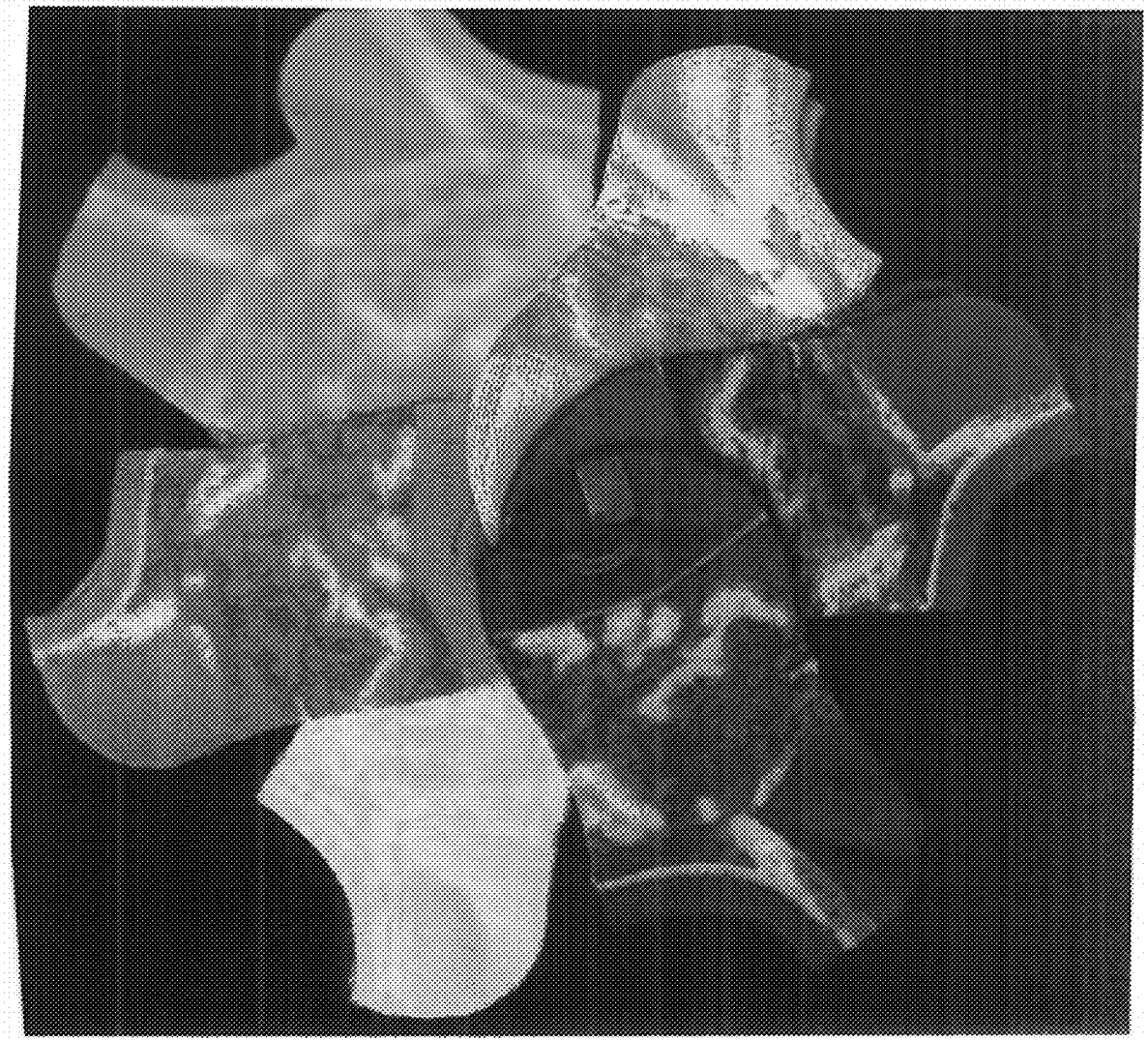
FIG. 2 shows a plurality of socks with a second tie dyed pattern in accordance with this invention.

In another embodiment, a random dye-pattern is generated with each pattern looking like a map in the sense that each pattern consists of several land areas surrounded by water areas or vice versa. Such patterns are generated either randomly or can be adapted from a library of tie dyed patents that are available from third parties. FIG. 2 show socks made using an image of this kind with one or more land/water areas as discussed above.

Figure 1A:
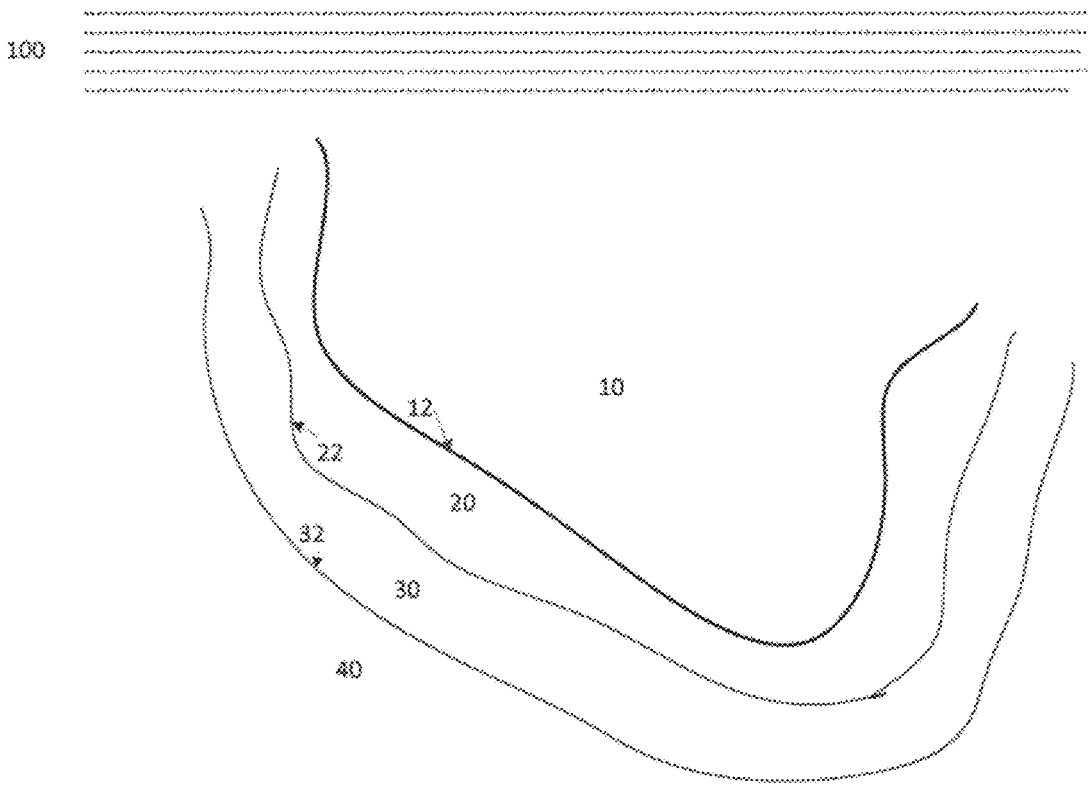
FIG. 1A shows a knit fabric with a tie dyed pattern in accordance with this invention.

FIG. 1A illustrates the structure of each of the patterns is formed. In each of the embodiments, a apparel is knit from color threads in consecutive courses 100 to form the pattern. Each respective pattern includes a main element 10 of a dominant color having a relative dark shade, and a secondary image element 40 having a much lighter color (typically white) and several peripheral zones 20, 30 interposed between the main element 10 and the secondary element 40. The first of these zones (10) follows at least partially a border line (12) of the main element 10. Importantly, the first zone 20 has a color that is a shade lighter than the color of the main element 10. The next element 30 follows at least partially the border line 22 of the first zone 20. The next element 30 has a color that is a shade that is lighter than the shade of zone 20, and so on. Generally, the patterns may be formed with one, two, three, etc, intermediate zones, each zone having a shade lighter than the previous zone. Preferably, the last zone should be close to but slightly darker than the shade of secondary element 40. It should be appreciated that the intermediate zones can be fairly narrow, e.g., 1-3 mm wide. They need to be just wide enough so that they imitate the bleeding of color in a real tie dyed material.

Figure 3:
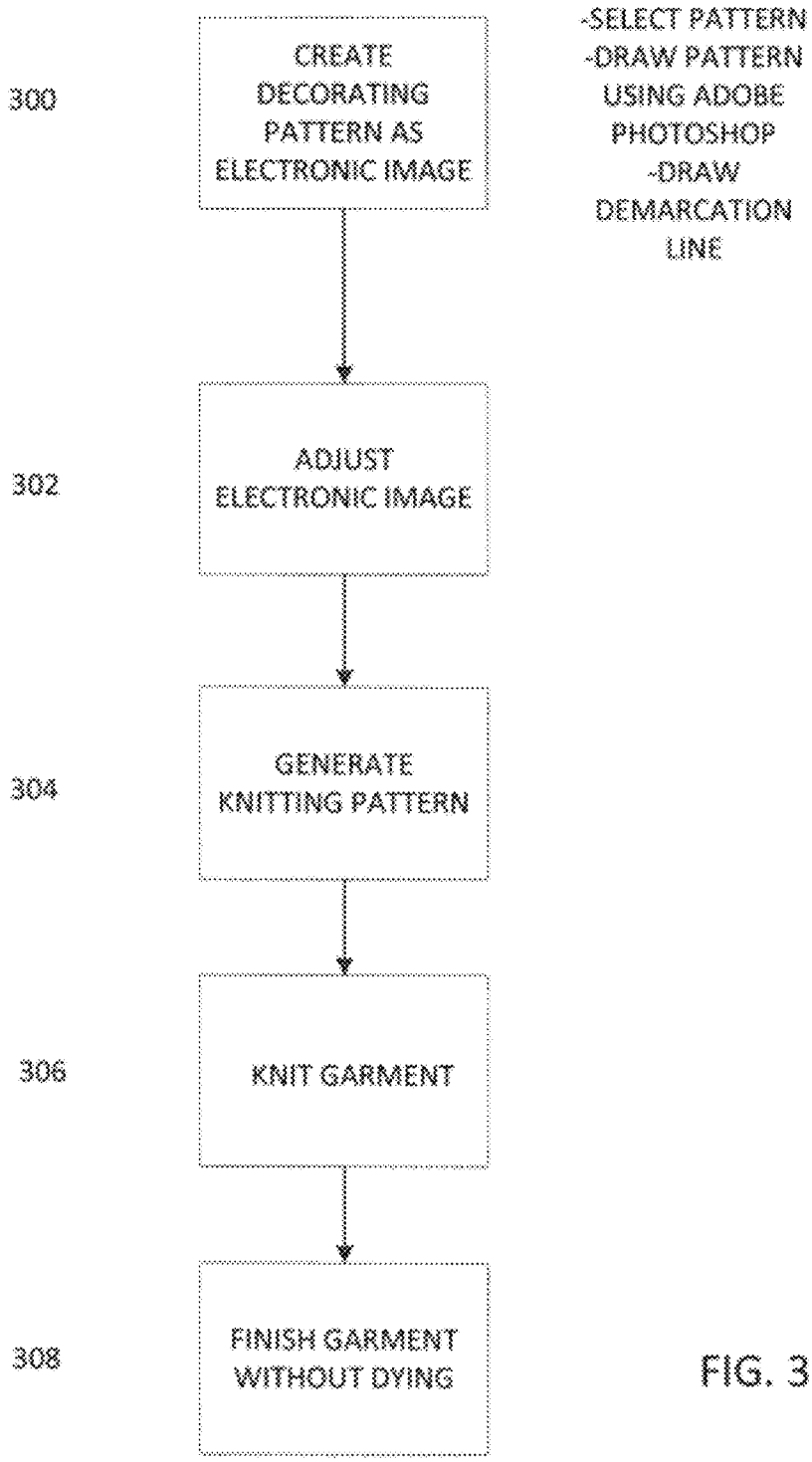
FIG. 3 shows a flow chart illustrating the steps for making the knitted apparel.

The method of making a apparel having a tie dyed appearance or look is summarized by the flow chart of FIG. 3. In step 300 a decorating pattern is obtained. The patterns shown in FIGS. 1 and 2 can be generated or drawn using graphic programs such as Adobe Illustrator® and having paint brush tools. Preferably at least some of the adjacent lines are colored using different shades of the same color (such as two or three of shades of orange, green, blue, etc., as discussed above) As shown in FIG. 1, the lines result in bands of different shades that are changed gradually starting with a darker shade to simulate the bands resulting from the bleeding of a dye into the material during the tie-dye process.

Figure 1B:
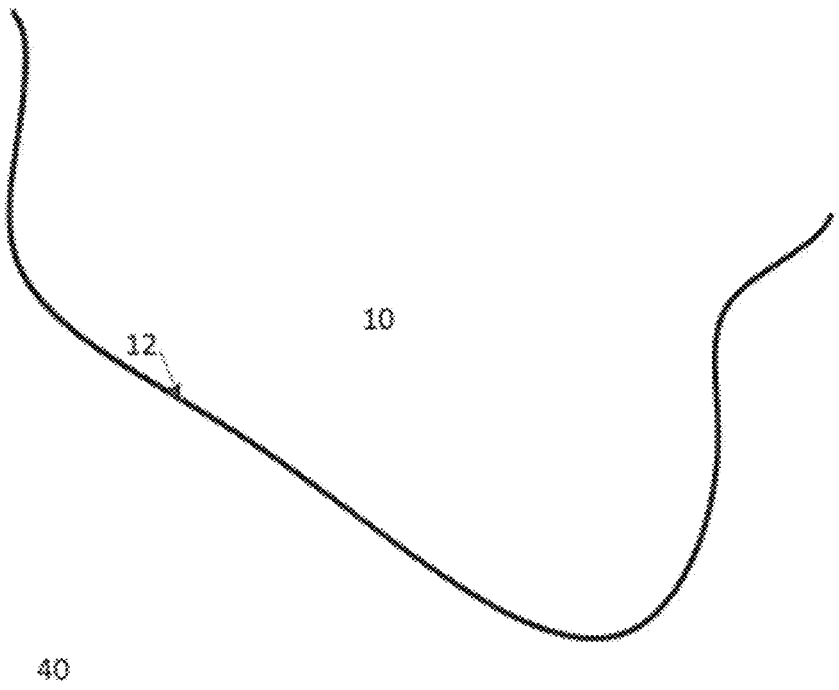
FIG. 1B shows a knit fabric with a line sketch of the pattern.

In an alternate embodiment, an artist draws or otherwise selects the outline or partial outline of main image element 10 as shown in FIG. 1B. A software program is then used to generate the secondary zones 20, 30 etc. The software program can be created to generate these zones so that they have a constant width, or a variable width. The second option gives the final apparel a more authentic look.

Once a desired electronic image is completed, it is then reviewed to insure that it is compatible with a computerized knitting machine. During this step (302), small changes are made, if necessary, to the decorating pattern by shifting some color shades in a manner that does not affect the esthetic appearance of the image. Also some details that may be too small or impractical to knit may be omitted or erased.

The corrected or adjusted decorating pattern is translated using off-the shelf software into a knitting pattern (step 304). The resulting knitting pattern is then used in a computerized knitting machine to make the desired apparel, such as socks, gloves, etc. (step 306).

It should be appreciated that in the conventional tie-dye technique, usually the apparel or apparel is finished and then colored, in the present invention, the complete apparel is knitted from colored yarns and is not dyed. Moreover, because each individual yarn is dyed separately so that it has a particular shade, the resulting knit material does not fade over time like real tie-dyed materials but maintain their vibrant colors for long periods of time. In step 308 the apparel is finished as needed.

The described method can be used to make various knit apparels such as socks, gloves, scarves, etc., using a system of colored threads, wherein the apparel itself is not dyed after the knitting is completed.

Numerous modifications may be made to the invention without departing from its scope as defined in the appended claims.

I claim:

1. A method of making a knit apparel comprising the steps of:

obtaining a decorating pattern including a main image element in a dominant color and having a demarcation line, a secondary image element having a second color different from said dominant color and a plurality of intermediate zones disposed along and following the shape of said demarcation line and separating said main image element from said secondary image element, wherein said intermediate zones having one of respective intermediate zone shade, the shades of the zones changing gradually toward said second color with the zone adjacent to said main image element having a shade slightly different than said dominant color and the zone adjacent to the secondary image element having a respective shade slightly different from said secondary color thereby creating a tie-dyed effect for said decorating pattern;

generating a knitting pattern from said decorating pattern; and knitting said knit apparel using said knitting pattern.

2. The method of claim 1 wherein said secondary image is white.

3. The method of claim 1 wherein said main image element and said zones have shapes selected to imitate for said knit apparel a tie-dye effect.

4. The method of claim 1 wherein said decorating pattern includes only one intermediate zone.

5. The method of claim 1 wherein said decorating pattern includes two or more intermediate zones.

6. The method of claim 1 wherein said zones form a plurality of bands having at least different shading.

7. The method of claim 6 wherein said bands have variable widths.

8. The method of claim 1 wherein said decorating pattern is selected from a library of tie-dye patterns.

9. The method of claim 1 wherein said decorative pattern includes at least a land area defining said main image element.

10. The method of claim 1 wherein said step of obtaining said decorating pattern, includes defining said main image element and using a predetermined sequence of programming steps to generate said intermediate zones.

11. A method of making a knit apparel having a tie-dyed appearance comprising the steps of:

obtaining a decorating pattern including a primary image element having a single, dominant color and defined by a demarcation line, a secondary image element having a second color; and at least one intermediate zone disposed at least partially around said primary image element along said demarcation line, said intermediate zone having a variable width and an intermediate color consisitinq of a bland of said dominant and and second color said variable width and said intermediate color being selected to provide said apparel with a tie-dyed appearance; and knitting said apparel so that the apparel has that decorating pattern without dying the apparel after it has been knit.

12. The method of claim 11 further comprising generating a knitting pattern from said decorating pattern, said knitting pattern being used to knit said apparel.

13. The method of claim 11 wherein said decorating pattern is generated using a software program.

14. The method of claim 11 wherein said decorating pattern is generated by first drawing a demarcation line defining said main image element and then generating said intermediate zone along said demarcation line.

15. The method of claim 11 wherein said main image element includes a plurality of generally parallel lines.

16. The method of claim 11 wherein said main image forms land areas.

17. The method of claim 1 wherein said dominant color is darker than said second color, with each intermediate zone having an intermediate color blended from said dominant and second color with intermediate zones being disposed closer to said main image having a respective color closer to said dominant color then intermediate zones being disposed closer to said second image.

18. The method of claim 17 wherein the intermediate zones colors that are lighter than said main image and darker than said second image.

19. The method of claim 1 wherein each image and each zone is knit from a yarn having a single color.

* * * * *